US005796318A

United States Patent [19]

Ando et al.

[11] Patent Number: 5,796,318

[45] Date of Patent: Aug. 18, 1998

[54] DUAL TM-MODE DIELECTRIC RESONATOR APPARATUS EQUIPPED WITH WINDOW FOR ELECTROMAGNETIC FIELD COUPLING, AND BAND-PASS FILTER APPARATUS EQUIPPED WITH THE DIELECTRIC RESONATOR APPARATUS

[75] Inventors: Masamichi Ando, Kyoto; Shuichi Abe, Toyama, both of Japan

[73] Assignee: Murata Manufacturing Co., Ltd., Japan

[21] Appl. No.: 676,385

[22] PCT Filed: Jan. 24, 1995

[86] PCT No.: PCT/JP95/00067

§ 371 Date: Sep. 23, 1996

§ 102(e) Date: Sep. 23, 1996

[87] PCT Pub. No.: WO95/20248

PCT Pub. Date: Jul. 27, 1995

[30] Foreign Application Priority Data

Jan. 24, 1994 [JP] Japan ..... 6-005603

[51] Int. Cl.[6] ..... H01P 1/20; H01P 7/10

[52] U.S. Cl. ..... 333/202; 333/219.1; 333/230; 29/600

[58] Field of Search ..... 333/202, 212, 333/219, 219.1, 230; 29/600

[56] References Cited

U.S. PATENT DOCUMENTS

| | | | |
|---|---|---|---|
| 4,839,773 | 6/1989 | Ishikawa et al. | 361/321 |
| 5,638,037 | 6/1997 | Kurisu et al. | 333/219.1 X |

FOREIGN PATENT DOCUMENTS

| | | |
|---|---|---|
| 0064799 | 11/1982 | European Pat. Off. . |
| 56-39703 | 4/1981 | Japan . |
| 57-194603 | 11/1982 | Japan . |
| 61-157101 | 7/1986 | Japan . |
| 63-313901 | 12/1988 | Japan . |
| 63-318801 | 12/1988 | Japan . |
| 224608 | 2/1990 | Japan . |
| 634303 | 5/1994 | Japan . |
| 224601 | 2/1996 | Japan . |

OTHER PUBLICATIONS

Ishikawa et al. "800 MHz High Power Duplexer Using TM Dual Mode Dielectric Resonators", IEEE MTT-S Digest, vol. III, pp. 1617–1620, Jun. 1, 1992.

Youhei Ishikawa et al., "Duplexer Using Dielectric TM Dual Mode Resonator for Cellular Base Station," Proceedings of the 1991 IEICE Fall Conference, Part 2, Communications and Electronics, C-91, pp. 2–372, Sep. 5, 1991 together with a partial English translation thereof.

*Primary Examiner*—Seungsook Ham

*Attorney, Agent, or Firm*—Ostrolenk, Faber, Gerb & Soffen, LLP

[57] ABSTRACT

A dual TM-mode dielectric resonator apparatus comprises a dual TM-mode dielectric resonator consisting of two columnar TM-mode dielectric resonators (1) crossed inside a cavity (2); and a partition plate (3) providing a window for electromagnetic field coupling between an external apparatus and the dielectric resonator. The partition (3) is disposed on the side surface of the cavity (2) opposing the external apparatus and constituted by forming a first shield conductor (30*a*) on a first main plane (S1) of a dielectric sheet (50) and a second shield conductor (30*b*) on a second main plane (S2). The first shield conductor (30*a*) includes parallel slits (32) formed in parallel with the longitudinal direction of one of the TM mode dielectric resonators, while the second shield conductor (30*b*) includes slits (31) formed in a region substantially opposed to the first slits (32). Further, a plurality of such dual TM-mode dielectric resonator apparatus described above are combined to form a band-pass filter. Accordingly, the degree of electromagnetic field coupling can be adjusted easily and precisely by adjusting the width of the first slits (31).

14 Claims, 9 Drawing Sheets

DUAL TM-MODE DIELECTRIC RESONATOR APPARATUS EQUIPPED WITH WINDOW FOR ELECTROMAGNETIC FIELD COUPLING, AND BAND-PASS FILTER APPARATUS EQUIPPED WITH THE DIELECTRIC RESONATOR APPARATUS

TECHNICAL FIELD

The present invention relates to a dual TM-mode dielectric resonator apparatus equipped with a window for electromagnetic field coupling, and also to a band-pass filter apparatus equipped with a plurality of dielectric resonator apparatuses mentioned above.

BACKGROUND ART

The Japanese patent Laid-Open publication No. Showa 61-157101 discloses a dual TM-mode dielectric resonator in which two TM-mode dielectric resonators are provided in the same cavity, and the respective modes are crossed to each other, with an object for miniaturizing a dielectric resonator using a TM-mode such as a $TM_{110}$ mode or the like. Also, there has conventionally been known such a technique that a dielectric filter is made up by using a plurality of such multiple mode dielectric resonators.

When a plurality of dual TM-mode dielectric resonators are arranged to form an electromagnetic coupling between respective two dual TM-mode dielectric resonators, it is necessary to allow only magnetic field components in a predetermined direction to be transmitted and, for example, to shield magnetic field components perpendicular to the predetermined direction, so that a coupling is formed between resonance modes in a predetermined direction.

Further, when a primary coupling is formed by magnetic field components in a certain direction while a subordinate coupling is formed by magnetic field components in a direction perpendicular to the direction of the primary coupling, so that an attenuation pole is formed by, for example, jumping over two stages of the resonators to couple two resonators before and after the two stages of the resonators, it is conventional practice to use a partition plate acting as a window for electromagnetic field coupling as shown in FIG. 9.

As shown in FIG. 9, in a rectangular-cylinder-shaped cavity 2 comprising a dielectric having a shield conductor 2*a* formed on an outer surface thereof, there is placed a cross-shaped dielectric resonator 1 which has a dual TM-mode comprising two rectangular-columnar-shaped dielectrics which cross perpendicularly to each other. Then, a partition plate 3 which shields one opening of the cavity 2 is provided so as to be opposed to the front face of the dielectric resonator 1. The partition plate 3 comprises: a shield conductor 30*s* in which a plurality of slitted conductor openings 33 are formed on one surface of a dielectric plate 50 made of a ceramic plate composed of a ceramic material such as $2MgO, SiO_2—ZrSiO_4$ or the like, the conductor openings 33 being arranged so that their longitudinal directions are parallel to the horizontal direction and parallel to each other, as shown in FIG. 9; and a shield conductor 30*c* formed on an entire surface of four side faces of the dielectric plate 50. Further, a coupling adjustment plate 4 formed of a metal plate is soldered on the shield conductor 30*c* to cover a part of the slitted conductor openings 33.

However, in such a conventional dielectric resonator apparatus, the shield conductor 30*s* needs to be formed by baking a satisfactorily solderable silver paste so that the coupling adjustment plate 4 of a metal plate, can be soldered for the makeup of the partition plate 3 as shown in FIG. 9. Nonetheless, such a satisfactorily solderable silver paste generally has an extremely low adhesiveness to the dielectric plate such as a ceramic plate or the like. To favorably solder the coupling adjustment plate 4 with its adhesiveness maintained high, it has been necessary to provide the dielectric plate 50 with such a two-layered structure that a silver electrode film is formed on the surface of the dielectric plate 50 as a lower layer by baking the highly adhesive silver paste, while the favorably solderable silver paste is baked as an upper layer. In such a method, unfavorably, there occur shifts or distortions due to the overlapped coating of the silver paste, and this makes it difficult to enhance the dimensional accuracy of the slitted conductor openings 33. Also, when the coupling adjustment plate 4 is soldered to the shield conductor 30*s*, there is such a further problem that the solder covers unnecessary places so that the size of the conductor openings 33 is changed.

FIG. 10 shows an area 70 covered by the solder when the coupling adjustment plate 4 is soldered onto the dielectric plate 50 formed of a ceramic plate. In FIG. 10, the one-dot chain line represents a position of the coupling adjustment plate 4.

As shown in FIG. 10, a coverage of the solder up to between the slitted conductor openings 33 would make it impossible to open or close the coupling adjustment plate 4 with a hinge structure at such places, so that the coupling adjustment can not longer be attained. Also, with the use of the partition plate 3 of such a structure, it is difficult to adjust, for example, the longitudinal size of each slitted conductor opening 33 by cutting a film of the shield conductor 30*s*. In this case, the coupling adjustment must be made only with the coupling adjustment plate 4, resulting in a lower degree of freedom for adjustment as well as a great difficulty in accomplishing fine adjustment.

A first object of the present invention is to provide a dual TM-mode dielectric resonator apparatus capable of easily adjusting a coupling by a dimensional adjustment of the conductor openings, apart from the coupling adjustment plate.

A second object of the present invention is to provide a dual TM-mode dielectric resonator apparatus capable of easily enhancing the pattern precision of the slitted conductor openings.

A third object of the present invention is to provide a dual TM-mode dielectric resonator apparatus capable of performing a good soldering of a metal plate serving as a coupling adjustment plate for the windows for electromagnetic field coupling, and also capable of easily forming slitted conductor openings.

A fourth object of the present invention is to provide a band-pass filter apparatus equipped with a plurality of dual TM-mode dielectric resonator apparatuses which are capable of attaining the above-mentioned first to third objects.

DISCLOSURE OF INVENTION

A dielectric resonator apparatus according to the present invention is characterized in comprising:

- a dual TM-mode dielectric resonator comprising two columnar-shaped TM-mode dielectric resonators placed in a cavity and crossing each other perpendicularly; and
- a window for electromagnetic field coupling, provided on a side face of the cavity opposed to an external apparatus, for forming an electromagnetic coupling between the external apparatus and the dielectric resonator;

wherein the window for electromagnetic field coupling is made up by forming a first shield conductor on a first main surface of a dielectric plate and by forming a second shield conductor on a second main surface of the dielectric plate, wherein a plurality of slitted first conductor openings parallel to one another are formed on the first shield conductor in such an array that longitudinal directions of the first conductor openings are parallel to a longitudinal direction of predetermined one TM-mode dielectric resonator out of the two TM-mode dielectric resonators; and wherein a second conductor opening is formed over a range in the second shield conductor including a range generally opposite to a range over which the plurality of first conductor openings are arrayed.

Also, the dielectric resonator apparatus is characterized in that:

the first shield conductor is formed by baking an Ag paste including a glass frit; and the second shield conductor is formed so as to have a two-layered structure which is formed by forming a first conductor and thereafter forming a second conductor, wherein the first conductor is formed by baking an Ag paste including a glass frit, and the second conductor is formed by baking an Ag paste composed only of Ag.

Further, the dielectric resonator apparatus is characterized in further comprising a coupling adjustment plate which is formed of a metal plate electrically connected to the second shield conductor and is fixed to the second shield conductor so as to be projected into the second conductor opening and which serves for adjusting a degree of electromagnetic coupling depending on an extent to which the coupling adjustment plate is projected into the second conductor opening.

Still further, the dielectric resonator apparatus is characterized in that the degree of electromagnetic coupling is adjusted and set by changing a clearance between the coupling adjustment plate and the dielectric plate.

Still further, the dielectric resonator apparatus is characterized in that the dielectric plate is a ceramic plate.

A band-pass filter according to the present invention is characterized in comprising a plurality of dielectric resonator apparatuses as claimed in any one of claims 1 through 5 which are juxtaposed so as to be electromagnetically coupled to one another via the window for electromagnetic field coupling, wherein any magnetic coupling of an unnecessary mode is suppressed by the plurality of first conductor openings of the window for electromagnetic field coupling, and two dielectric resonators adjacent to each other are electromagnetically coupled to each other by the second conductor opening of the window for electromagnetic field coupling.

In the above-described dielectric resonator apparatus, the range over which the plurality of slitted first conductor openings formed on the first main surface of the dielectric plate and the second conductor openings formed on the second main surface of the dielectric plate overlap each other substantially serves as the windows for electromagnetic field coupling. With this arrangement, the window for electromagnetic field coupling can electromagnetically couple one dielectric resonator parallel to the longitudinal direction of the first conductor openings out of the two dual TM-mode dielectric resonators with an external apparatus through the plurality of slitted first conductor openings, while the window for electromagnetic field coupling can electromagnetically shield the other dielectric resonator perpendicular to the longitudinal direction of the first conductor openings from the external apparatus.

Therefore, the degree of electromagnetic coupling can be easily adjusted by adjusting the width of the first conductor openings. Also, upon adjustment of the size of the window for electromagnetic field coupling composed of the plurality of slitted first conductor openings and the second conductor openings opposite to the first conductor openings, the opening width of the second conductor openings can be easily adjusted by cutting or other machining process, so that the degree of electromagnetic coupling can be easily adjusted.

Also, preferably, the first shield conductor is formed by baking an Ag paste including a glass frit, and the second shield conductor is formed by forming the first conductor and by thereafter forming a second conductor so as to have a two-layered structure, where the first conductor is formed by baking the Ag paste including a glass frit and the second conductor is formed by baking the Ag paste composed of only Ag. Therefore, the first shield conductor is formed by the baking of a first Ag paste with a high adhesiveness to the dielectric plate such as a ceramic plate or the like, and the second shield conductor is formed by the first conductor through the baking of the first Ag paste with a high adhesiveness to the dielectric plate such as a ceramic plate or the like and by the baking of a second Ag paste with a high bonding property to an electrically conductive bonding material such as solder or the like. Thus, since the second shield conductor has a high bonding property with the conductive bonding material such as solder or the like, the second shield conductor can firmly bond a metal plate or other conductive films, for example. Moreover, since the first shield conductor having the plurality of slitted first conductor openings formed and arrayed thereon is formed by the baking of the first Ag paste with a high adhesiveness to the dielectric plate such as a ceramic substrate or the like, the pattern precision of the plurality of slitted first conductor openings can be enhanced.

Further, the dielectric resonator apparatus may comprise a coupling adjustment plate which is formed of a metal plate electrically connected to the second shield conductor and fixed to the second shield conductor so as to project to the second conductor openings, and which serves to adjust the degree of electromagnetic coupling in accordance with the extent of projection into the second conductor openings. Then, the degree of electromagnetic coupling can be easily adjusted.

Still further, in the dielectric resonator apparatus, since the degree of electromagnetic coupling is adjustably set by changing the clearance between the coupling adjustment plate and the dielectric plate, the degree of electromagnetic coupling can be easily and precisely adjusted.

Still further, preferably, the dielectric plate is a ceramic plate.

Further, a band-pass filter apparatus according to the present invention comprises the plurality of is dielectric resonator apparatuses which are juxtaposed so as to be electromagnetically coupled to one another via the window for electromagnetic field coupling, wherein magnetic coupling of unnecessary modes is suppressed by a plurality of first conductor openings of the window for electromagnetic field coupling, and two adjacent dielectric resonators are electromagnetically coupled to each other by the second conductor openings of the window for electromagnetic field coupling. With the above-described arrangement, the degree of electromagnetic coupling between the two adjacent dielectric resonators can be easily and precisely adjusted.

BEST MODE FOR CARRYING OUT THE INVENTION

Embodiments according to the present invention will be explained in detail hereinbelow.

First Embodiment

Figure 1:
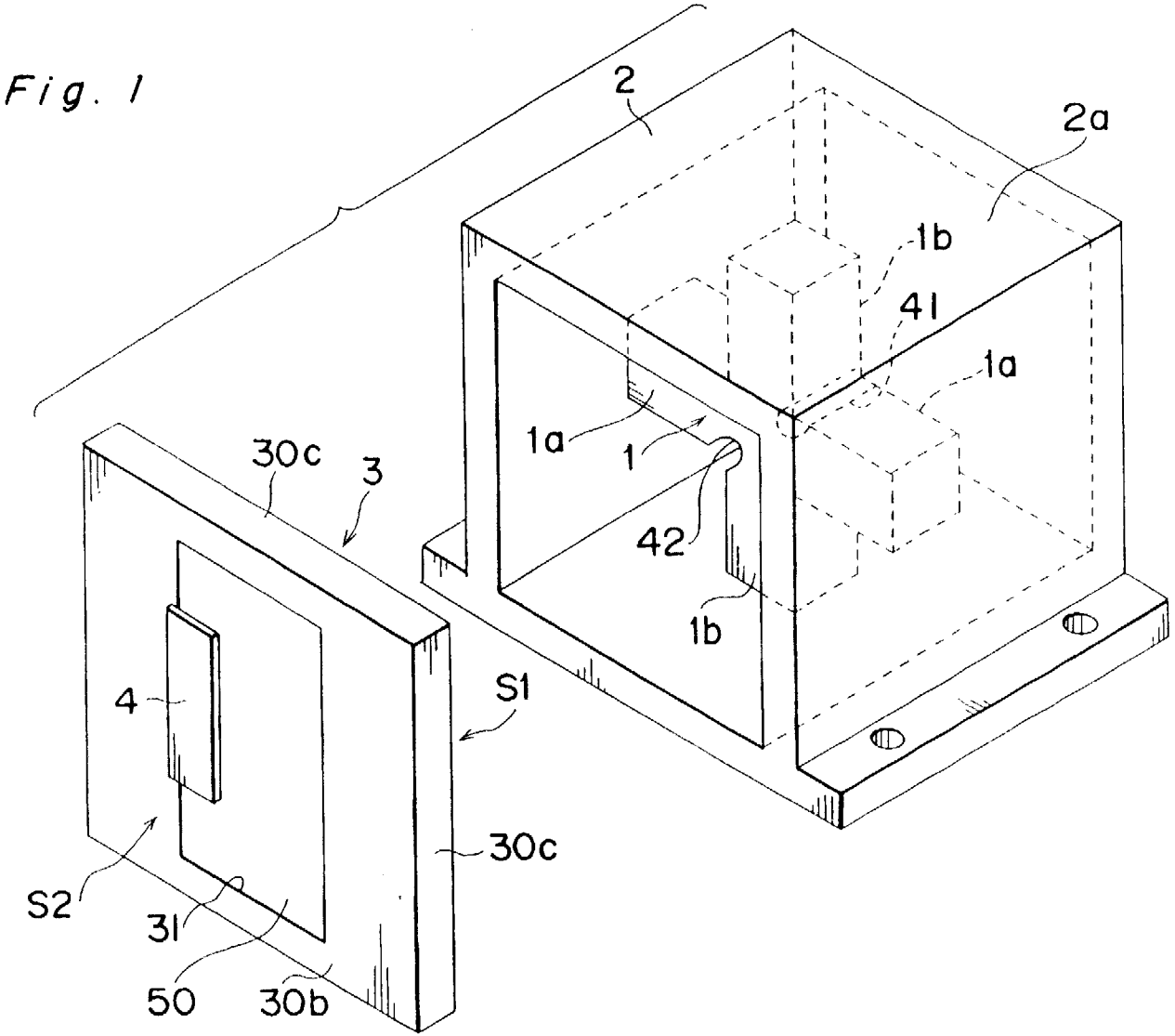
FIG. 1 is an exploded perspective view showing a structure of a dual TM-mode dielectric resonator apparatus which is a first embodiment according to the present invention.

FIG. 1 is an exploded perspective view of a dual TM-mode dielectric resonator apparatus according to a first embodiment of the present invention.

Figure 2:
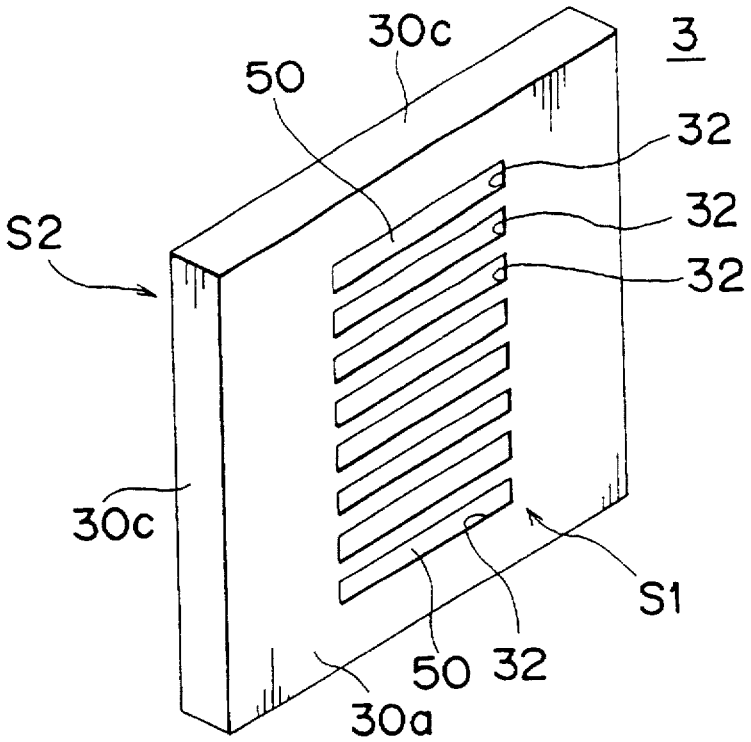
FIG. 2 is a perspective view showing a dielectric plate 50 of FIG. 1 as viewed from a side of a first main surface S1.
Figure 5:
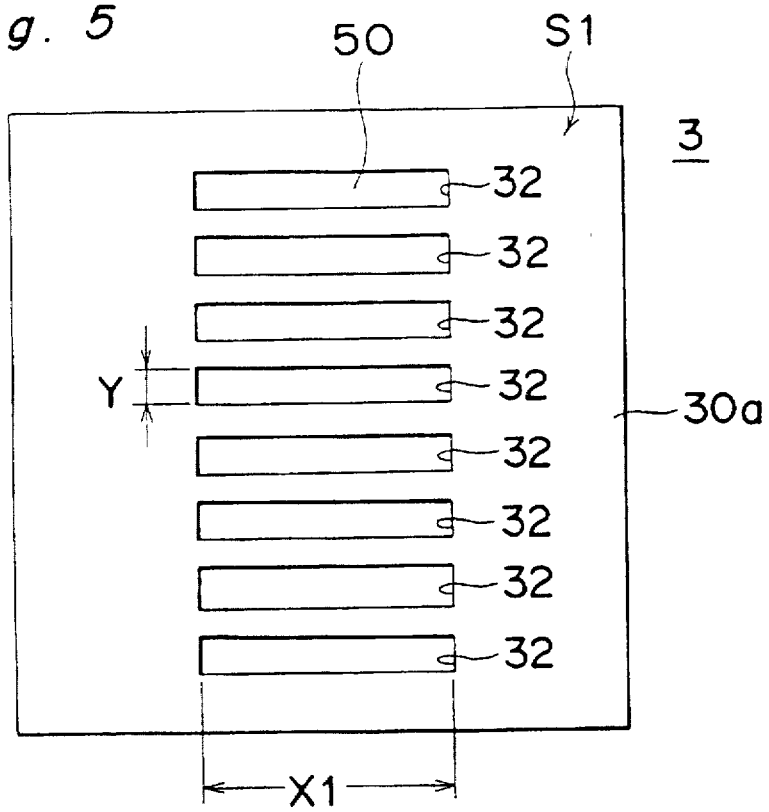
FIG. 5 is a plan view showing the first main surface S1 of the dielectric plate of FIG. 1.
Figure 6:
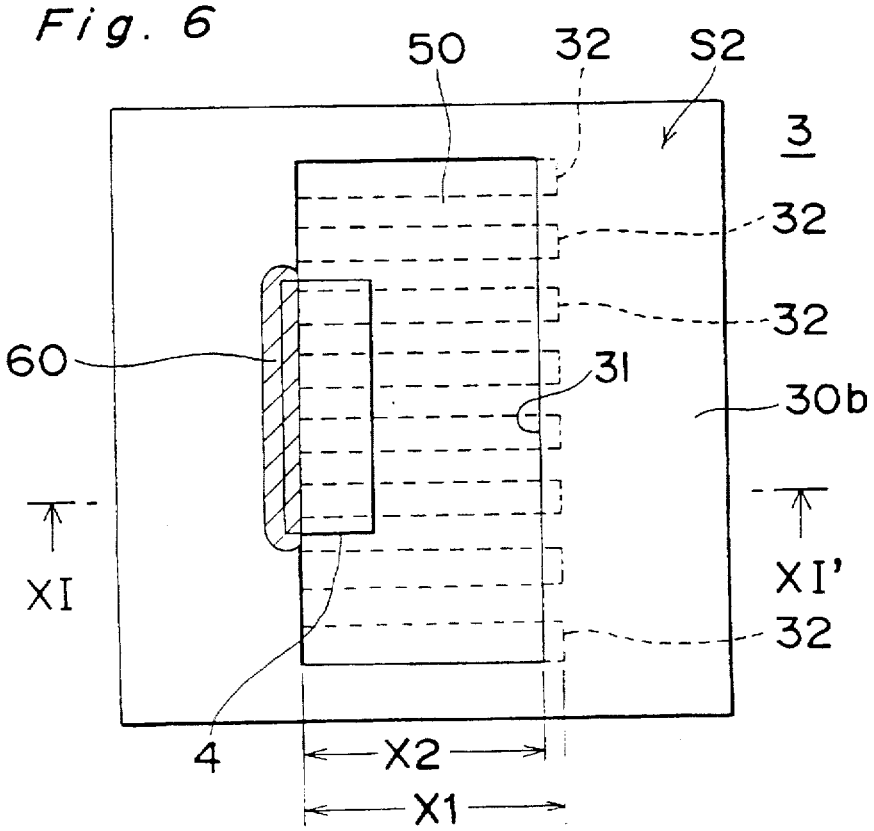
FIG. 6 is a plan view showing a second main surface S2 of the dielectric plate 50 of FIG. 1.

As shown in FIG. 1, a cross-shaped dielectric resonator 1 comprising rectangular-columnar-shaped two dielectrics 1*a* and 1*b* perpendicular to each other and having a dual resonance mode is placed in a rectangular-cylinder-shaped cavity 2 formed of a dielectric having a shield conductor 2*a* formed on an outer surface thereof. This dielectric resonator 1 and the cavity 2 are formed by integral molding using a dielectric ceramic material. Then, a partition plate 3 that shields one of the openings of the cavity 2 is provided on a side face of the cavity 2 opposed to an external apparatus such as another dielectric resonator apparatus or a coupling loop in such a manner that the partition plate 3 is opposed to the front face of the dielectric resonator 1. This partition plate 3 is made up by forming shield conductors as described below on the individual faces of a dielectric plate 50 formed of a ceramic plate of a ceramic material such as 2MgO, $SiO_2$—$ZrSiO_4$, or the like:

(a) On a first main surface S1 of the dielectric plate 50, as shown in FIGS. 2 and 5, a shield conductor 30*a* in which a plurality of slitted conductor openings 32 each having a strip shape are formed is formed in such an array that their longitudinal directions are parallel to the horizontal direction as well as the longitudinal direction of the dielectric 1*a*, and also parallel to one another;

(b) On a second main surface S2 of the dielectric plate 50, as shown in FIGS. 1 and 6, conductor openings 31 are formed over a range approximately opposite to the range over which the slitted conductor opening 32 are arrayed, and then, a shield conductor 30*b* is formed. Further on the second main surface S2, a coupling adjustment plate 4 is soldered and fixed to the shield conductor 30*b* so as to cover a part of the conductor openings 31 and project into the part of the conductor openings 31, and then, the coupling adjustment plate 4 is electrically connected to the shield conductor 30*b*; and (c) A shield conductor 30*c* is formed on the entire four side faces of the dielectric plate 50.

FIG. 2 is a perspective view of the partition plate 3 shown in FIG. 1 as viewed from the side of the first main surface S1. On the shield conductor 30*a* formed on the first main surface S1 of the dielectric plate 50, a plurality of slitted conductor openings 32 are formed in an array form. At a position of the shield conductor 30*b* formed on the second main surface S2 of the dielectric plate 50, which position is generally opposite to the range over which the plurality of slitted conductor openings 32 are arrayed, a rectangular shaped conductor opening 31 shown in FIG. 1 is formed.

Figure 3:
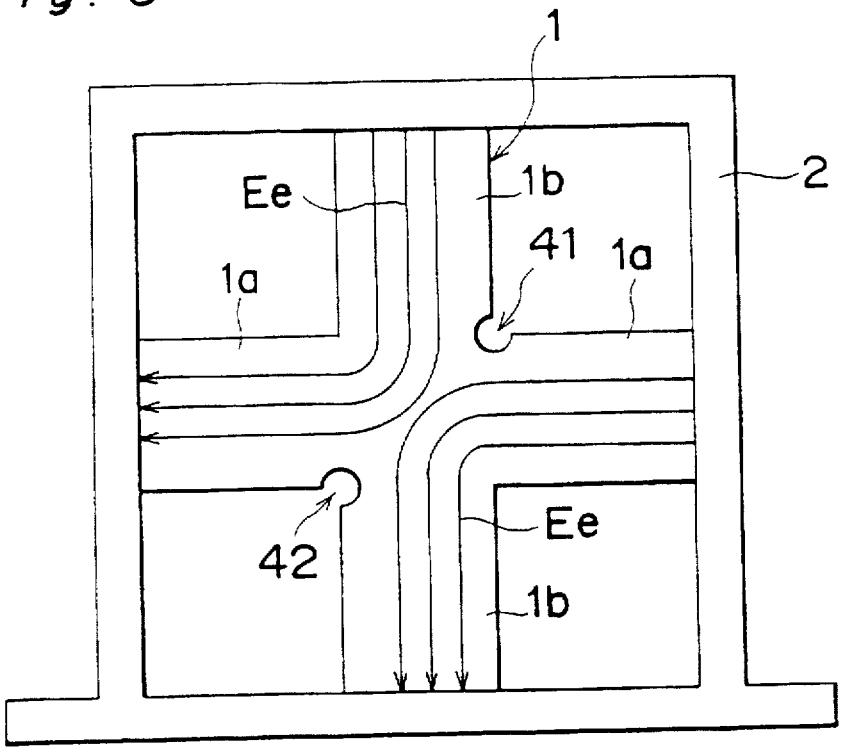
FIG. 3 is a front view showing electric lines of force of an even mode in the dielectric resonator apparatus of FIG. 1.
Figure 4:
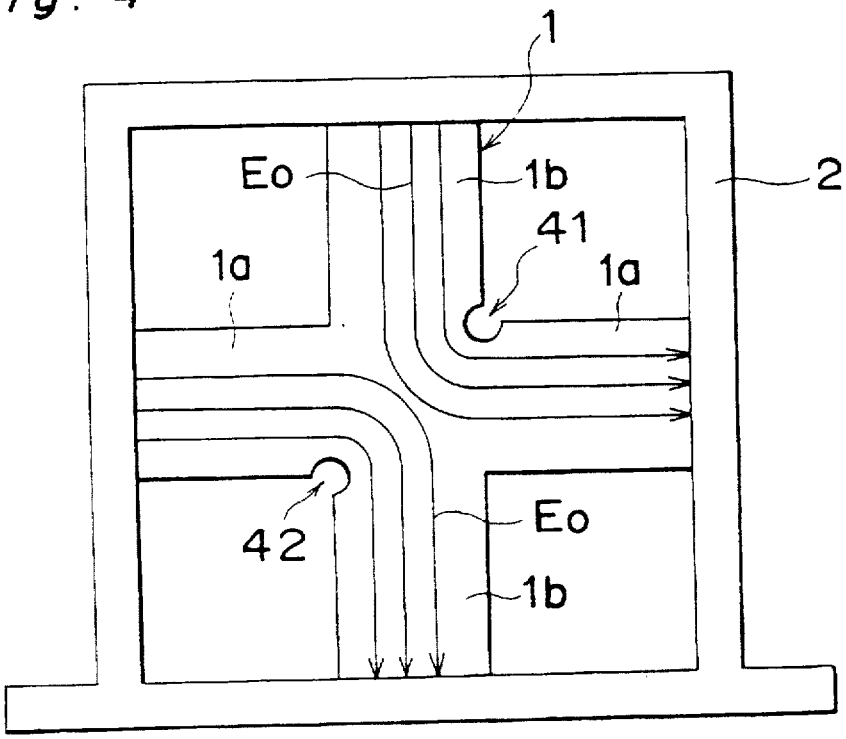
FIG. 4 is a front view showing electric lines of force of an odd mode in the dielectric resonator apparatus of FIG. 1.

FIGS. 3 and 4 are views illustrating resonance modes of the dielectric resonator apparatus shown in FIG. 1, wherein FIG. 3 shows electric lines of force of an even mode in the dielectric resonator apparatus while FIG. 4 shows electric lines of force of an odd mode in the dielectric resonator apparatus.

As shown in FIGS. 3 and 4, the dielectric resonator 1 has such a configuration that columnar-shaped dielectrics 1*a* and 1*b* are integrated together so as to cross each other. Also, the dielectric resonator 1 has cut-out portions 41 and 42 for mode coupling are formed, as shown in FIGS. 3 and 4, at an upper right corner and a lower left corner of the portion where the rectangular-columnar shaped dielectrics 1*a* and 1*b* cross each other. This arrangement makes up two dielectric resonators crossing each other perpendicularly. With this arrangement, as shown in FIGS. 3 and 4, the resonance frequency of the even mode and that of the odd mode can be set so as to be slightly different from each other, by cutting off a part of the electric lines of force of the odd mode with the cut-out portions 41 and 42 for mode coupling. As a result, a mode coupling is generated between the resonance modes of the two TM-mode dielectric resonators by the columnar-shaped dielectrics 1*a* and 1*b*, so that the dielectric resonator 1 operates as a dual TM-mode dielectric resonator.

FIGS. 5 and 6 are plan views of the partition plate 3 shown in FIG. 1, wherein FIG. 5 is a plan view of the first main surface S1, and FIG. 6 is a plan view of the second main surface S2. The shield conductor 30*b* formed on the second main surface S2 of the dielectric plate 50 shown in FIG. 6 differs from the shield conductor 30*a* formed on the first main surface S1 of the dielectric plate 50 in the following points.

The shield conductor 30*a* formed on the first main surface S1 of the dielectric plate 50 has a one-layer structure of a conductor film formed by the baking of an Ag paste with a high adhesiveness to the dielectric plate 50 that is a ceramic plate. The Ag paste for the shield conductor 30*a* (hereinafter, referred to as a first Ag paste) preferably contains 40% to 60% of a glass frit and 60 to 40% of Ag. The first Ag paste more preferably contains 50% of glass frit and 50% of Ag.

Figure 11:
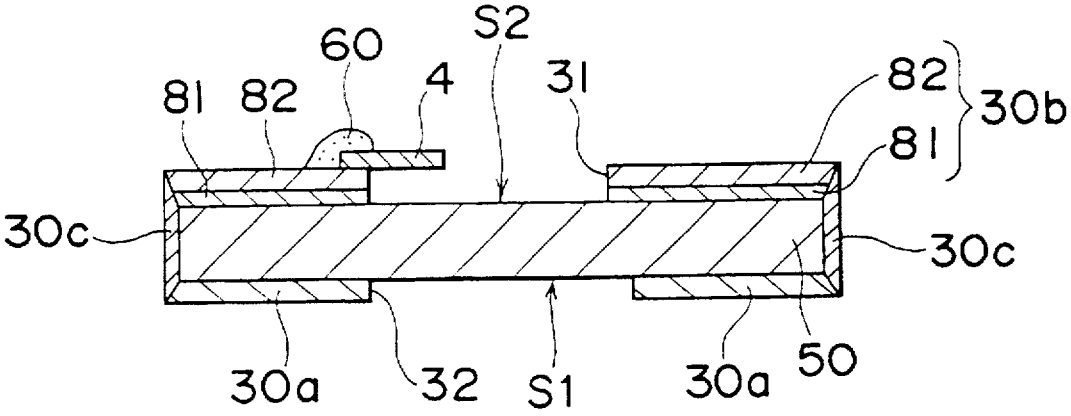
FIG. 11 is a sectional view showing a cross sectional construction of the partition plate 3 taken along a line XI–XI of FIG. 6.

On the other hand, as shown in FIG. 11, after a conductor film 81 is formed as a lower layer on the second main surface S2 of the dielectric plate 50 by the baking of an electrically conductive paste such as the first Ag paste or the like having a high adhesiveness to the dielectric plate 50, which is a ceramic plate, a conductor film 82 is formed as an upper layer on the conductor film 81 by the baking of an electrically conductive paste such as a second Ag paste or the like having a high bonding property with conductive bonding materials such as solder or the like. In other words, the shield conductor 30*b* is formed into a two-layered structure comprising two conductor films 81, 82. It is noted here that the second Ag paste is composed of an Ag paste containing only Ag. This makes the shield conductor 30*b* into a conductor film having a high adhesiveness to the dielectric plate 50 of a ceramic plate and having a high bonding property to solder or the like.

Further, as shown in FIG. 6, the conductor opening 31 formed on the shield conductor 30*b* is required only to be of a simple rectangular shape.

Also, as shown in FIG. 5, since the shield conductor 30*a* formed on the main surface S1 of the dielectric plate 50 is formed into a one-layer structure of a conductor film by the baking of a conductive paste having a high adhesiveness to the dielectric plate 50, which is a ceramic plate, the fine slitted conductor openings 32 can be easily patterned.

As shown in FIG. 5, the plurality of slitted conductor openings 32 are formed in an array as conductor openings of the shield conductor 30*a*. As a result, when at least two dual TM-mode dielectric resonators of the present embodiment are placed to make up a band-pass filter apparatus, one TM-mode dielectric resonator of the dielectric 1*b* placed so that its longitudinal direction makes the vertical direction (hereinafter, a "dielectric placed so that its longitudinal direction makes the vertical direction" is abbreviated as "a vertical dielectric," while a "dielectric placed so that its longitudinal direction makes the horizontal direction" is abbreviated as a horizontal dielectric") is magnetically coupled to another TM-mode dielectric resonator of the vertical dielectric 1*b* in another dielectric resonator apparatus adjacent to the former dielectric resonator, while the former TM-mode dielectric resonator of the dielectric 1*b* is almost no coupled to another TM-mode dielectric resonator of the dielectric 1*a* perpendicular thereto. Also, although the dielectric resonator of the horizontal dielectric 1*a* is magnetically coupled to the dielectric resonator of the horizontal dielectric 1*a* in another dielectric resonator apparatus adjacent to the former dielectric resonator, the former dielectric resonator is almost not coupled to the TM-mode dielectric resonator of the dielectric 1*b* perpendicular thereto. It is noted that the former coupling between the TM-mode dielectric resonators of the dielectrics 1*a* and 1*b* is a primary coupling having a relatively high degree of coupling, while the latter coupling of the two TM-mode dielectric resonators of the dielectrics 1*a* and 1*b* is a subordinate coupling having a relatively low degree of coupling.

Referring to FIG. 5, a prolonged slit length X1 of each of the conductor openings 32 causes the primary coupling to increase, while conversely, a shortened slit length X1 causes the primary coupling to decrease. This makes it possible to set a degree of coupling between adjacent dielectric resonators. On the other hand, an increased slit width Y of the conductor openings 32 causes the subordinate coupling to increase, while a decreased slit width Y causes the subordinate coupling to decrease. This makes it possible to adjustably set attenuating characteristics of the band-pass filter apparatus equipped with at least two dual TM-mode dielectric resonators.

Also, as shown in FIG. 6, the opening quantity of the window for electromagnetic field coupling formed by the partition plate 3 is changed by changing a width X2 of the conductor opening 31 so that the width X2 of the conductor opening 31 is made narrower than a width X1 of the slitted conductor openings 32. This makes it possible to adjustably set the degree of coupling between two dual TM-mode dielectric resonators adjacent to each other. In other words, with respect to electromagnetic fields perpendicular to the longitudinal direction of the slitted conductor openings 32, magnetic coupling can be suppressed as unnecessary modes.

Figure 10:
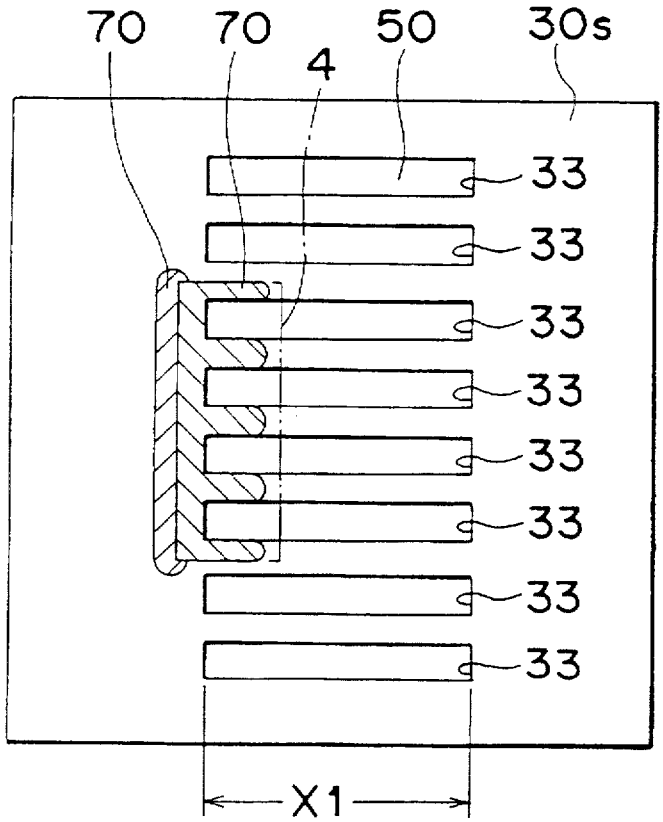
Fig. 10 PRIOR ART
FIG. 10 is a plan view showing a partition plate 3 in the dielectric resonator apparatus according to the prior art.

Further, as shown in FIG. 6, when one side of the coupling adjustment plate 4 is soldered with solder 60, a virtual conductor opening quantity of the conductor opening 31, or the degree of electromagnetic coupling can be adjusted and set by changing the degree to which the coupling adjustment plate 4 covers the conductor opening 31, that is, the extent to which the coupling adjustment plate 31 is projected into the conductor opening 31. Further, the above-mentioned conductor opening quantity, or the degree of electromagnetic coupling can be finely adjusted by changing the quantity of clearance between the coupling adjustment plate 4 and the partition plate 3. For such adjustment, since the solder will not invade the space between the conductor opening 31 and the coupling adjustment plate 4 unlike the conventional example shown in FIG. 10, it is possible to avoid the conventional problem that the solder would invade the space between the coupling adjustment plate 4 and the partition plate 3 so that the coupling adjustment plate could no longer be opened or closed.

Second Embodiment

Figure 7:
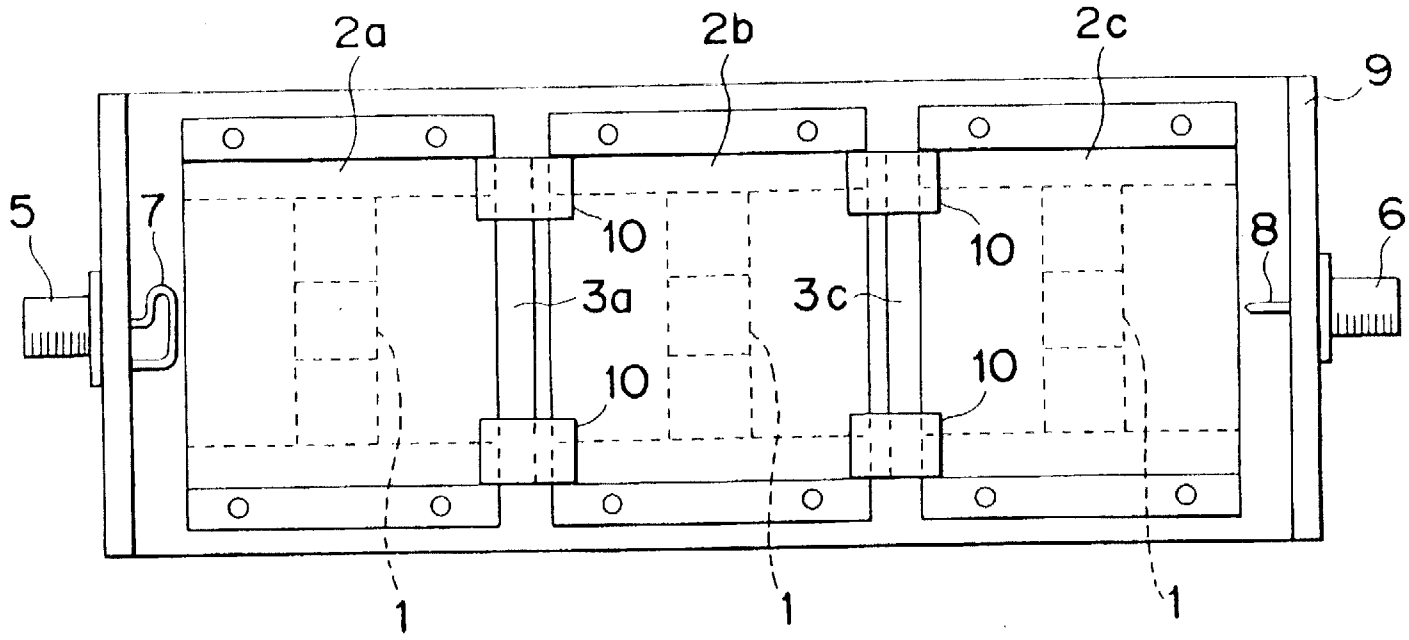
FIG. 7 is a plan view showing a band-pass filter apparatus which is a second embodiment according to the present invention with a cover removed.
Figure 8:
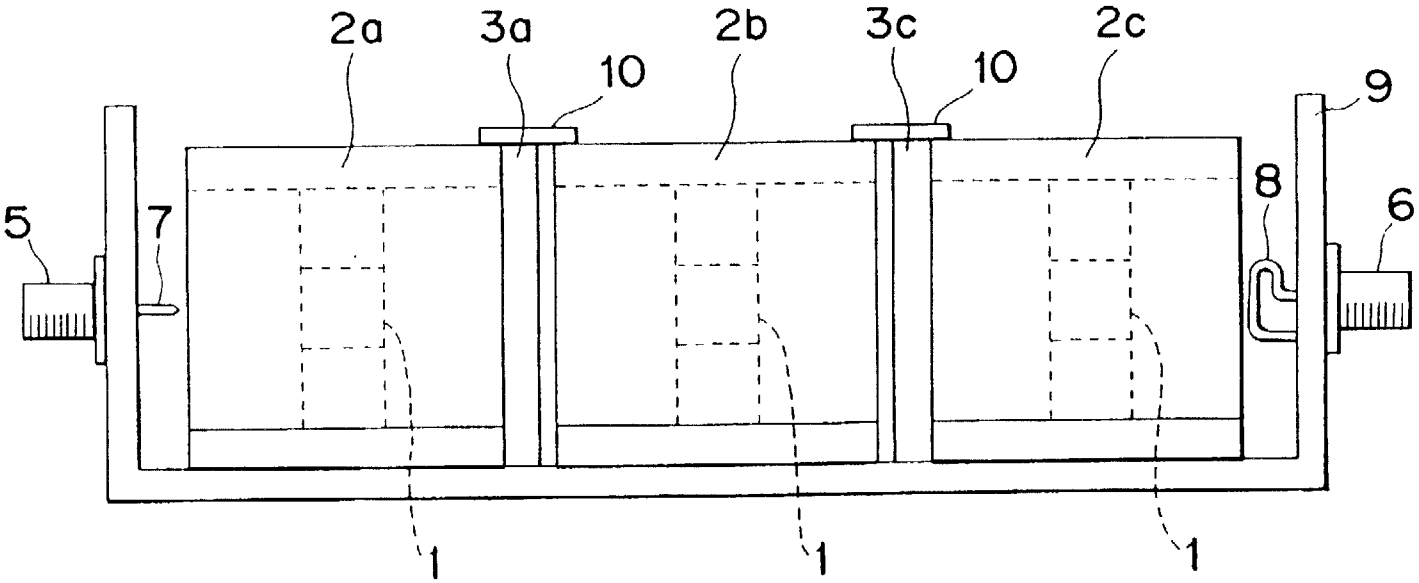
FIG. 8 is a front view showing the band-pass filter of FIG. 7 with the cover removed.
Figure 9:
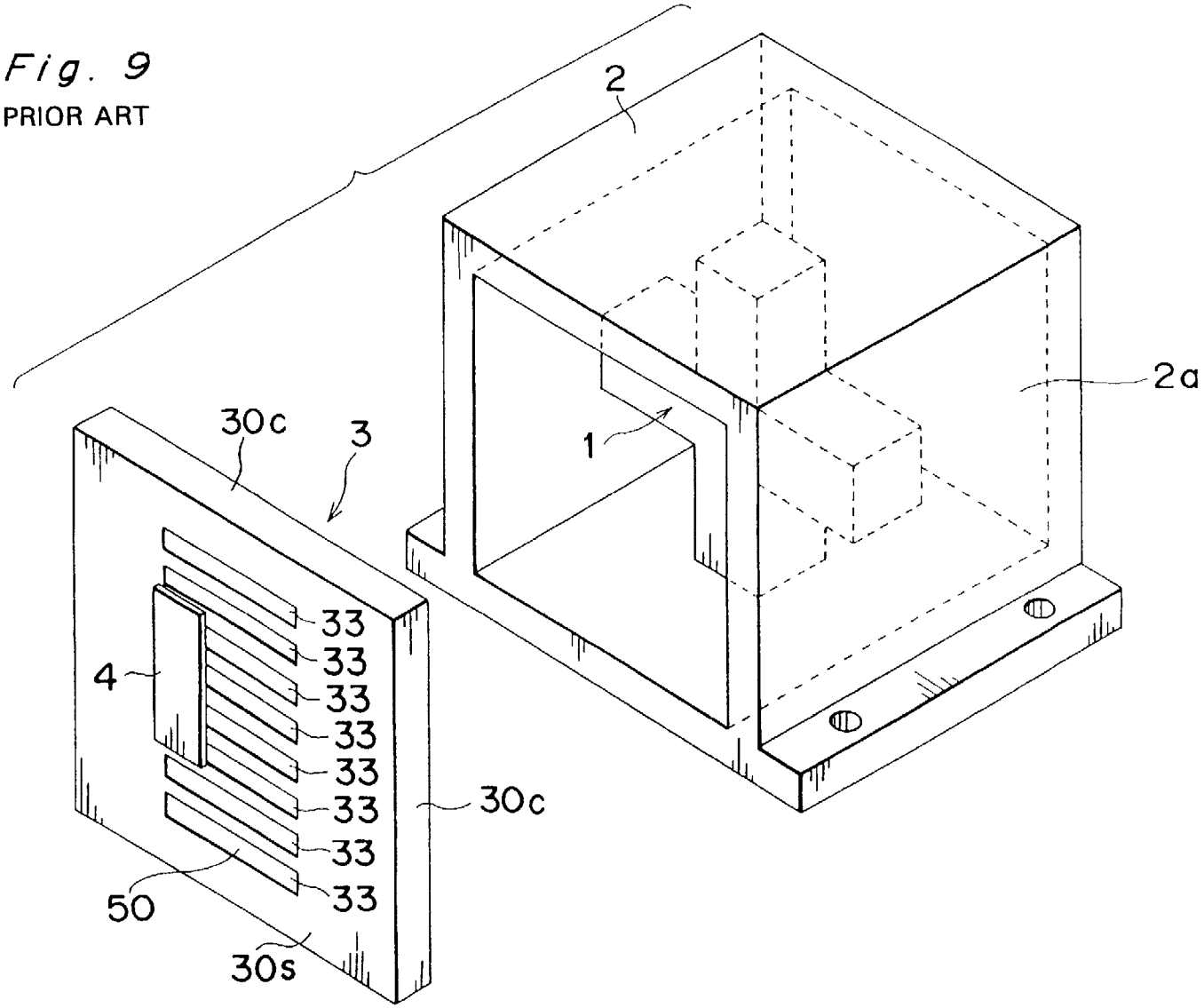
Fig. 9 PRIOR ART
FIG. 9 is an exploded perspective view showing a construction of a dielectric resonator apparatus according to the prior art.

FIGS. 7 and 8 are views showing an arrangement of a band-pass filter apparatus which is a second embodiment of the present invention and which comprises a plurality of dual TM-mode dielectric resonator apparatuses shown in FIGS. 1 through 6. FIG. 7 is a plan view showing the band-pass filter apparatus with a metal cover (not shown) removed, and FIG. 8 is a front view of the band-pass filter apparatus with the metal cover removed likewise.

Referring to FIGS. 7 and 8, reference characters 2*a*, 2*b* and 2*c* denote cavities in the dual TM-mode dielectric resonator apparatus shown in FIG. 1, respectively, and 3*a* and 3*c* denote a partition plate which is formed of a ceramic plate having the same arrangement as the partition plate shown in FIG. 1. No partition plate is provided on two openings of the cavity 2*b*, and the partition plates 3*a* and 3*c* are joined with one opening of each of the cavities 2*a* and 2*c* so as to be opposed to each opening of the cavities 2*a* and 2*c*. Then, a window for electromagnetic field coupling is placed and formed between each two adjacent dual TM-mode dielectric resonators. Both upper portions of adjacent two cavities (2*a* and 2*b*, 2*b* and 2*c*) are joined by soldering a metal plate 10 thereto.

As shown in FIGS. 7 and 8, the space between the two adjacent cavities (2*a* and 2*b*, 2*b* and 2*c*) is not completely sealed by one metal plate, but the two partition plates 3*a* and 3*c* are provided. This arrangement allows the position of the coupling adjustment plate 4 on the partition plates 3*a* and 3*c* to be adjusted, so that the degree of coupling between the two dual TM-mode dielectric couplers can be easily adjusted as described above. Further, coaxial connectors 5 and 6 are provided in the center portions of both end faces of a metal casing 9, and coupling loops 7 and 8 are connected between center conductors of the coaxial connectors 5 and 6 and the metal casing 9 of an earth conductor, respectively.

In the second embodiment constructed as described above, the coupling loop 7 connected to the coaxial connector 5 is electromagnetically connected to the vertical dielectric resonator 1*b* of the dual TM-mode dielectric resonator apparatus 1 provided within the cavity 2*a*. In this arrangement, the dielectric resonator 1*b* provided within in the cavity 2*a* is electromagnetically coupled to the horizontal dielectric resonator 1*a* as described above. Also, the dielectric resonator 1*a* provided within the cavity 2*a* is electromagnetically connected to the horizontal dielectric resonator 1*a* provided within the cavity 2*b* via the partition plate 3*a* having a plurality of horizontal slitted first conductor openings 32. In this arrangement, the dielectric resonator 1*a* provided within the cavity 2*b* is electromagnetically coupled to the vertical dielectric resonator 1*b*. Further, the dielectric resonator 1*b* provided within the cavity 2*b* is electromagnetically connected to the vertical dielectric resonator 1*b* provided within the cavity 2*c* via the partition plate 3*c* having a plurality of vertical, slitted first conductor openings 32. In this arrangement, the dielectric resonator 1*b* in the cavity 2*c* is electromagnetically coupled to the horizontal dielectric resonator 1*a*. Still further, the dielectric resonator 1*a* provided within the cavity 2*c* is electromagnetically connected to the coupling loop 8 connected to the coaxial connector 6.

Therefore, a band-pass filter composed of six-stage dielectric resonators is made up by providing the three dual TM-mode dielectric resonators 2*a*, 2*b* and 2*c* between the coaxial connectors 5 and 6.

In the present embodiment, the partition plates 3*a* and 3*c* have been joined to the cavities of both ends, out of the three cavities 2*a*, 2*b* and 2*c*. However, the partition plates 3a and 3c need only to be provided between adjacent two cavities (2*a* and 2*b*, 2*b* and 2*c*). For example, a partition plate 3 may be joined to one opening of the cavities 2*b* and 2*c* without providing the partition plates 3*a* and 3*c* to two openings of the cavity 2*a*, in which case the same effects can be obtained.

In the above-described embodiment, the partition plate 3 has such a structure that the partition plate 3 is separated from the cavity 2. However, the present invention is not limited to this, but the partition plate 3 according to the present invention, which partition plate serves as a window for electromagnetic field coupling, may be formed in such a manner that the dielectric plate 50 involved is integrally molded with the cavity 2 as a part of the cavity 2. In this case, the number of components is reduced, and the assembly processes are also simplified.

In the above embodiment, the partition plate 3 has been used, but the present invention is not limited thereto. Instead of the partition plate 3, a window for electromagnetic field coupling may be used in which a first metal plate having a conductor opening 31 and comprising a coupling adjustment plate 4 is combined with a second metal plate having a plurality of slitted conductor openings 32. In this case, the degree of coupling of electromagnetic coupling can be adjusted by using the coupling adjustment plate 4.

Industrial Applicability

As described above in detail, according to the present invention, a dual TM-mode dielectric resonator apparatus is implemented by providing: a dual TM-mode dielectric resonator comprising two columnar-shaped TM-mode dielectric resonators which are placed within the cavity 2 and which are perpendicular to each other; and a partition plate 3 having a window for electromagnetic field coupling, which is provided on a side face of the cavity 2 opposite to an external apparatus and which serves for forming an electromagnetic coupling between the external apparatus and the dielectric resonators. The partition plate 3 is implemented by forming a first shield conductor 30*a* on a first main surface S1 of a dielectric plate 50 and forming a second shield conductor 30*b* on a second main surface S2 of the dielectric plate 50. In this arrangement, a plurality of slitted first conductor openings 32 which are parallel to one another are formed on the first shield conductor 30*a* in such an array that the longitudinal directions of the first conductor openings 32 are parallel to the longitudinal direction of one predetermined TM-mode dielectric resonator out of the two TM-mode dielectric resonators. Also, a conductor opening 31 is formed over a range in the second shield conductor 30*b* including a range generally opposite to the range over which the plurality of first conductor openings 32 are arrayed. Further, a band-pas filter can be implemented by providing a plurality of dual TM-mode dielectric resonator apparatuses as described above. With the arrangement as described above, the degree of electromagnetic coupling can be easily adjusted by adjusting the width of the first conductor openings 32. Moreover, the pattern precision of the slitted first conductor openings 32 can be easily enhanced, a metal plate as the coupling adjustment plate 4 for the window for electromagnetic field coupling can be successfully soldered, and the slitted conductor openings 32 can be easily formed.

We claim:

1. A dual TM-mode dielectric resonator apparatus comprising:

a dual TM-mode dielectric resonator comprising two columnar-shaped TM-mode dielectric resonators placed in a cavity and crossing each other perpendicularly; and a window for electromagnetic field coupling, provided on a side face of said cavity opposite to an external apparatus, for forming an electromagnetic coupling between said external apparatus and said dielectric resonator;

wherein said window for electromagnetic field coupling comprises a first shield conductor on a first main surface of a dielectric plate and a second shield conductor on a second main surface of said dielectric plate, wherein said first shield conductor has an array of a plurality of slitted first conductor openings parallel to one another such that longitudinal directions of said first conductor openings are parallel to a longitudinal direction of one predetermined TM-mode dielectric resonator out of said two TM-mode dielectric resonators; and wherein a second conductor opening is formed in said second shield conductor in an area generally opposite to the plurality of first conductor openings.

2. The dielectric resonator apparatus as claimed in claim 1, wherein said first shield conductor comprised of a baked Ag paste including a glass frit, wherein said second shield conductor has a two-layered structure which is formed by a first conductor and a second conductor, and wherein said first conductor comprised of a baked Ag paste including a glass frit, and said second conductor is formed by baking an Ag paste composed only of Ag.

3. The dielectric resonator apparatus as claimed in claim 1, further comprising:

a coupling adjustment plate which is formed of a metal plate electrically connected to said second shield conductor and fixed to said second shield conductor so as to be projected into said second conductor opening and which serves for adjusting a degree of electromagnetic coupling depending on an extent to which said coupling adjustment plate is projected into said second conductor opening.

4. The dielectric resonator apparatus as claimed in claim 3, wherein the degree of electromagnetic coupling is adjusted and set by changing a clearance between said coupling adjustment plate and said dielectric plate.

5. The dielectric resonator apparatus as claimed in claim 1, wherein said dielectric plate is a ceramic plate.

6. A band-pass filter apparatus comprising a plurality of dielectric resonator apparatuses as claimed in claim 1, said apparatuses being juxtaposed so as to be electromagnetically connected to one another via said window for electromagnetic field coupling, wherein any magnetic coupling of an unnecessary mode is suppressed by said plurality of first conductor openings of said window for electromagnetic field coupling, and wherein two dielectric resonators adjacent to each other are electromagnetically coupled to each other by said second conductor opening of said window for electromagnetic field coupling.

7. A band-pass filter apparatus comprising a plurality of dielectric resonator apparatuses as claimed in claim 3, said apparatuses being juxtaposed so as to be electromagnetically connected to one another via said window for electromagnetic field coupling, wherein any magnetic coupling of an unnecessary mode is suppressed by said plurality of first conductor openings of said window for electromagnetic field coupling, and wherein two dielectric resonators adjacent to each other are electromagnetically coupled to each other by said second conductor opening of said window for electromagnetic field coupling.

8. A band-pass filter apparatus comprising a plurality of dielectric resonator apparatuses as claimed in claim 4, said apparatuses being juxtaposed so as to be electromagnetically connected to one another via said window for electromagnetic field coupling, wherein any magnetic coupling of an unnecessary mode is suppressed by said plurality of first conductor openings of said window for electromagnetic field coupling, and wherein two dielectric resonators adjacent to each other are electromagnetically coupled to each other by said second conductor opening of said window for electromagnetic field coupling.

9. A method of manufacturing a window for a dual TM-mode dielectric resonator apparatus comprising a dual TM-mode dielectric resonator including two columnar-shaped TM-mode dielectric resonators placed in a cavity and crossing each other perpendicularly, said window being provided on a side face of said cavity opposite to an external apparatus, for forming an electromagnetic coupling between said external apparatus and said dielectric resonator, said method comprising:

forming a first shield conductor on a first main surface of a dielectric plate and forming a second shield conductor on a second main surface of said dielectric plate, said first shield conductor being formed by baking an Ag paste including a glass frit, and said second shield conductor being formed by forming a first conductor and thereafter forming a second conductor, said first conductor being formed by baking an Ag paste including a glass frit, and said second conductor being formed by baking an Ag paste composed only of Ag;

forming a plurality of slitted first conductor openings parallel to one another on said first shield conductor such that longitudinal directions of said first conductor openings are parallel to a longitudinal direction of one of said two TM-mode dielectric resonators; and forming a second conductor opening in an area of said second shield conductor including an area generally opposite to the plurality of first conductor openings.

10. A method as claimed in claim 9, wherein the Ag paste for the first shield conductor contains approximately 40% to 60% glass frit and approximately 60% to 40% Ag.

11. A method as claimed in claim 9, wherein the Ag paste for the first shield conductor contains approximately 50% Ag and approximately 50% glass frit.

12. A method as claimed in claim 9, wherein the Ag paste for the first conductor of the second shield conductor contains approximately 40% to 60% glass frit and approximately 60% to 40% Ag.

13. A method as claimed in claim 9, wherein the Ag paste for the first conductor of the second shield conductor containing approximately 50% Ag and approximately 50% glass frit.

14. A method as claimed in claim 9, wherein the Ag paste for the first shield conductor and the Ag paste for the first conductor of the second shield conductor each contain approximately 50% Ag and approximately 50% glass frit.

* * * * *